US005937921A

United States Patent [19]

Guglielmini

[11] Patent Number: 5,937,921

[45] Date of Patent: Aug. 17, 1999

[54] STOPPER DEVICE FOR A BOTTLE FOR A WATER FOUNTAIN TYPE LIQUID DISPENSER

[75] Inventor: Bernard Guglielmini, Crimolois, France

[73] Assignee: Rical, Longvic, France

[21] Appl. No.: 08/949,451

[22] Filed: Oct. 14, 1997

[30] Foreign Application Priority Data

Oct. 1, 1997 [FR] France ..... 97 12219

[51] Int. Cl.[6] ..... B65B 1/04

[52] U.S. Cl. ..... 141/351; 141/364; 220/229; 215/303

[58] Field of Search ..... 141/346–354, 141/364; 215/303, 253, 254; 220/229

[56] References Cited

U.S. PATENT DOCUMENTS

| | | | |
|---|---|---|---|
| Re. 32,354 | 2/1987 | Savage | 222/81 |
| 4,033,472 | 7/1977 | Aichinger | 215/256 |
| 4,375,864 | 3/1983 | Savage | 222/81 |
| 4,699,188 | 10/1987 | Baker et al. | 141/17 |
| 4,874,023 | 10/1989 | Ulm | 141/364 |
| 5,370,270 | 12/1994 | Adams | 222/88 |
| 5,513,763 | 5/1996 | Adams et al. | 215/254 |
| 5,662,231 | 9/1997 | Adams et al. | 215/254 |
| 5,687,865 | 11/1997 | Adams et al. | 141/354 |
| 5,687,867 | 11/1997 | Lamoureux | 141/364 |

FOREIGN PATENT DOCUMENTS

| | | |
|---|---|---|
| 0641713A1 | 3/1995 | European Pat. Off. . |
| 2204546 | 5/1974 | France . |
| 90/03919 | of 0000 | WIPO . |
| 93/07057 | of 0000 | WIPO . |
| 93/07084 | of 0000 | WIPO . |

*Primary Examiner*—Steven O. Douglas
*Attorney, Agent, or Firm*—Beveridge, DeGrandi, Weilacher & Young, LLP

[57] ABSTRACT

A stopper device for a bottle having a neck provided with an outside bead at its free end and intended for use with a water fountain type liquid dispenser comprises a plastics material capsule having an end wall from which project in the same direction a substantially cylindrical outer skirt which has an inside bead which hooks behind the outside bead on the neck of the bottle and a substantially cylindrical inner chimney to receive a dispenser tube on the dispenser which nests in the chimney from the side of the end wall of the capsule when the bottle is fitted to the dispenser. The capsule further comprises a tamperproofing closure which closes off the chimney so that it is irrevocably and visibly destroyed upon nesting of the dispenser tube in the chimney and can comprise a diaphragm made up of a plurality of petals connected together by tear lines.

12 Claims, 6 Drawing Sheets

STOPPER DEVICE FOR A BOTTLE FOR A WATER FOUNTAIN TYPE LIQUID DISPENSER

BACKGROUND OF THE INVENTION

1. Field of the invention

The present invention relates to a stopper device for a bottle having a neck having an outside bead at its free end for use in a "water fountain" type liquid dispenser.

2. Description of the Prior Art

The dispensing of water from fountains that are generally cooled is widespread in countries such as the United States of America and certain Asian countries. The water to be dispensed is supplied in bottles having a capacity of five gallons (19/20 liters) which are placed upside-down on the dispenser, the latter dispensing the water in smaller quantities, for example in glasses.

There are two types of stopper device for such bottles, which are returnable against a deposit, and usually made of polycarbonate.

Stopper devices of the first type comprise a capsule which must be removed from the neck of the bottle before the latter is inverted to be placed on the dispenser. The major disadvantage of these capsules is that during the fitting of the bottle to the dispenser water flows out of the bottle and splashes the dispenser. The same thing occurs if the bottle must be removed from the dispenser before it is empty, for any reason.

The stopper devices of the second type, which are usually called "NON-SPILL" devices, comprise a plastics material capsule having an end wall from which project in the same direction a substantially cylindrical outer skirt which has a bead on the inside to hook behind the bead on the outside of the neck of the bottle and a substantially cylindrical inner chimney defining a passage that also passes through the end wall. This chimney is normally sealed by a stopper inside the free end of the chimney. This stopper has a particular shape so that it can be pushed out of the chimney and into the bottle by the dispenser tube on the dispenser. This stopper and the dispenser tube have complementary shapes such that when the bottle is in place on the dispenser the upwardly projecting dispenser tube fits inside the chimney, clips onto the stopper and then pushes the latter out of the chimney into the bottle, the stopper remaining clipped to the head of the dispenser tube. When the bottle is removed from the dispenser, whether empty or still containing water, the dispenser tube returns the stopper into the chimney before it leaves the latter itself. This stopper cooperating with the chimney of the capsule and with the dispenser tube of the dispenser thus constitutes an interior valve system that frees the passage for water to flow out of the bottle only when the latter is in place on the dispenser. It is therefore possible to fit the bottle to the dispenser and to remove it from the dispenser, even before it is empty, without risk of the contents of the bottle flowing out.

The valve system as such is described in documents U.S. Pat. No. 4,375,864 and U.S. Pat. No. Re 32,354 and capsules for bottles including this valve system are described in documents U.S. Pat. No. 5,232,125, U.S. Pat. No. 5,370,270, U.S. Pat. No. 5,513,763, WO-A-90/03919, WO-A-93/07057 and WO-A-93/07084, for example, to which documents explicit reference is made here.

An adhesive label is generally stuck onto the outside face of the end wall of the prior art capsules of the second type to close off the chimney, the aim of this label being to assure that the chimney is clean, i.e. to prevent foreign bodies entering it.

The main disadvantage of these prior art capsules is the absence of guarantee or tamperproofing means. In theory, each time the bottle is refilled at the source the capsule should be removed and replaced by a new capsule. When the bottle is empty it is very easy to refill it with tap water using a filler tube fitted with an end-piece matching the dispenser tube of the dispenser; when the end-piece of the filler tube is inserted into the chimney, this end-piece pushes the stopper from the chimney into the bottle, fills the bottle with tap water, and, on removing the end-piece of the filler tube, returns the stopper into the chimney after this fraudulent refilling.

In some of the aforementioned documents (WO-A-90/03919, WO-A-93/07057), the stopper is molded in one piece with the capsule at the free end of the chimney, to which the stopper is connected by a tearable area so that the stopper is detached from the chimney only the first time a dispenser tube enters the chimney. This connection of the stopper to the chimney through a tearable area therefore constitutes a tamper-evident feature since this tearable area is irreversibly destroyed on the first use. However, this feature is inoperative because it is situated inside the bottle, at an inaccessible and invisible location. In the case of a bottle fitted with the capsule, it is not possible to tell whether the stopper is still attached to the chimney or has already been separated from the latter.

Another problem of the prior art stopper devices concerns the attachment of the capsule to the neck of the bottle. On the prior art capsules the outer skirt can be torn along a tear line to facilitate the removal of the capsule from the neck of the bottle. This tear line starts from the free end of the skirt and extends only to a point just short of the inside bead for attaching the capsule to the neck of the bottle. Consequently, when the skirt is torn, the part attaching the capsule to the neck of the bottle remains intact and the capsule therefore remains attached to the neck and continues to fulfill its function. Moreover, a relatively high force must be exerted in order to remove the capsule from the neck of the bottle.

Finally, the prior art capsules do not include any means of preventing with certainty fraudulent removal of the capsule from the neck of a bottle without tearing the outer skirt.

Thus the prior art capsules do not include any reliable guarantee or tamperproofing means preventing fraudulent refilling of bottles equipped with these capsules. This is very important, in particular in countries with a low standard of living in which fraudulent refilling of the bottles with tap water can quickly become a profitable enterprise.

The present invention is directed to a stopper device for bottles of the type defined hereinabove including effective tamperproofing means.

The invention is also directed to a stopper device for bottles of the type defined hereinabove combining good tamperproofing with easy replacement of the capsule when the bottle is refilled at the source.

SUMMARY OF THE INVENTION

The present invention consists in a stopper device for a bottle having a neck provided with an outside bead at its free end and intended for use with a water fountain type liquid dispenser, the device comprising a plastics material capsule having an end wall from which project in the same direction a substantially cylindrical outer skirt which has an inside bead adapted to hook behind the outside bead on the neck of the bottle and a substantially cylindrical inner chimney adapted to receive a dispenser tube on the dispenser which nests in the chimney from the side of the end wall of the capsule when the bottle is fitted to the dispenser, the capsule further comprising a tamperproofing closure which closes the chimney so that it is irrevocably and visibly destroyed upon nesting of the dispenser tube in the chimney.

The closure is advantageously in one piece with the capsule, preferably being adapted to remain attached to the capsule after it is destroyed.

To this end the closure is preferably a diaphragm comprising at least two parts joined together by tear lines.

The diaphragm advantageously comprises at least three petal-shaped parts.

The closure is preferably substantially in the plane of the end wall of the capsule.

The outer skirt of said capsule is preferably extended beyond the bead for attachment to the neck of the bottle and includes tear means shaped to tear the skirt beyond the attachment bead.

Accordingly, when the skirt is torn, the capsule is no longer retained on the neck of the bottle.

The skirt can have at its free end a tamperproofing ring cooperating with an outside bead on said neck to make the capsule even more tamperproof.

Two illustrative and non-limiting embodiments of a stopper device in accordance with the invention will now be described in more detail with reference to the accompanying drawings.

DETAILED DESCRIPTION OF THE PREFERRED EMBODIMENTS

The stopper device as shown in FIGS. 1 through 4 is designed to close the neck 1 of bottles for a fountain type water dispenser, which bottles generally have a capacity of 5 gallons (19/20 liters) and are made of polycarbonate, for example.

Figure 1:
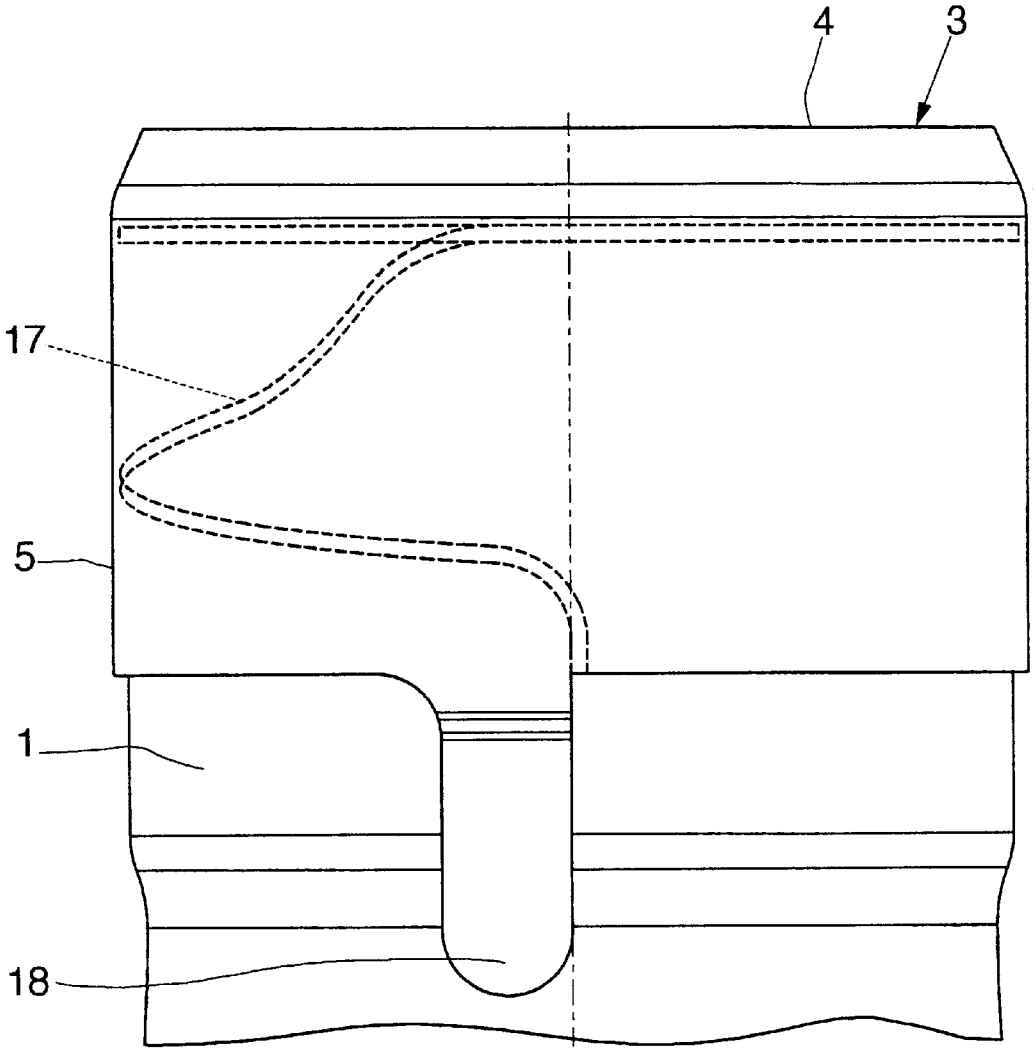
FIG. 1 is a view in lateral elevation of a first embodiment of a stopper device in accordance with the invention on a bottle neck.
Figure 2:
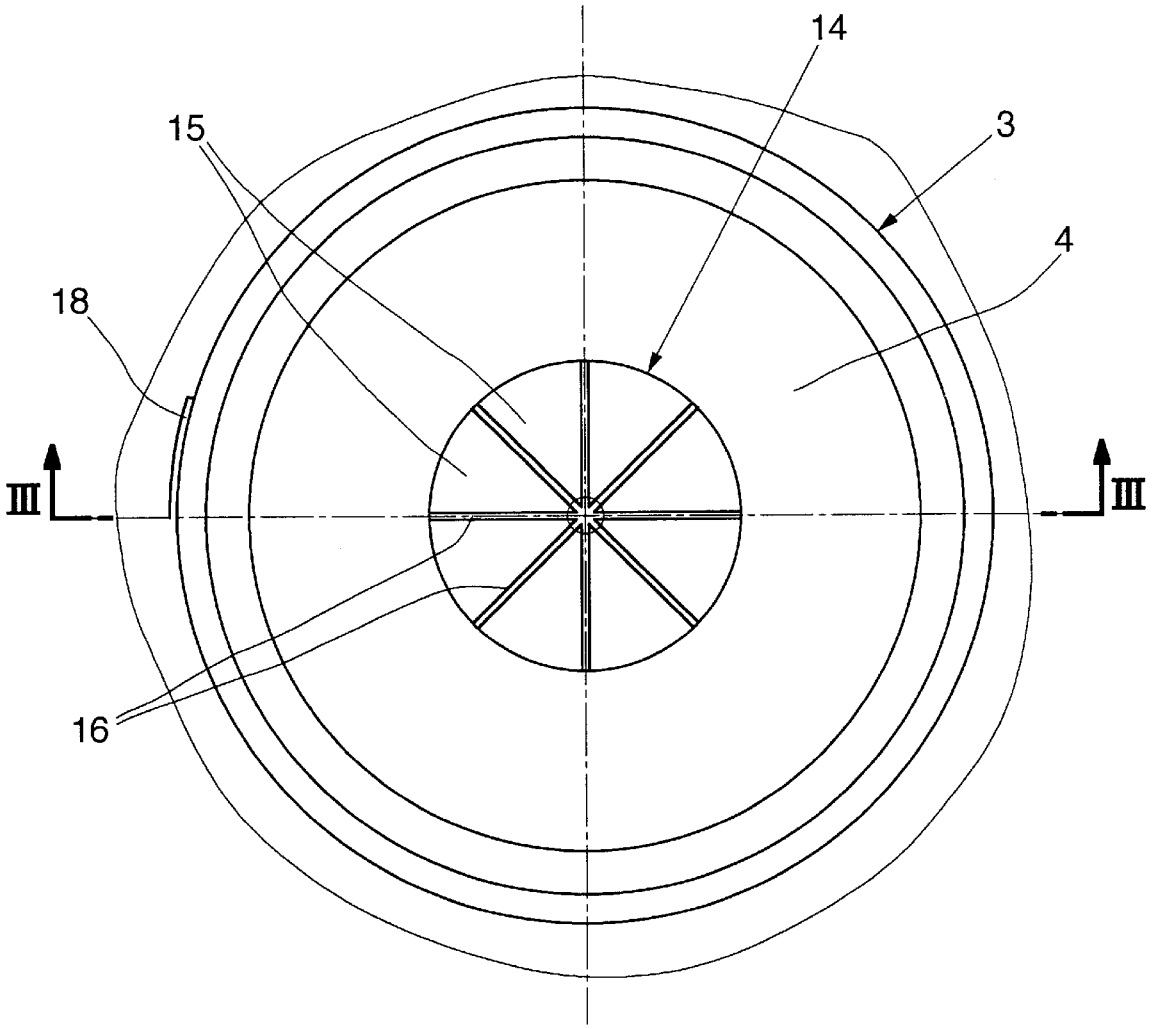
FIG. 2 is a plan view of the device from FIG. 1.
Figure 3:
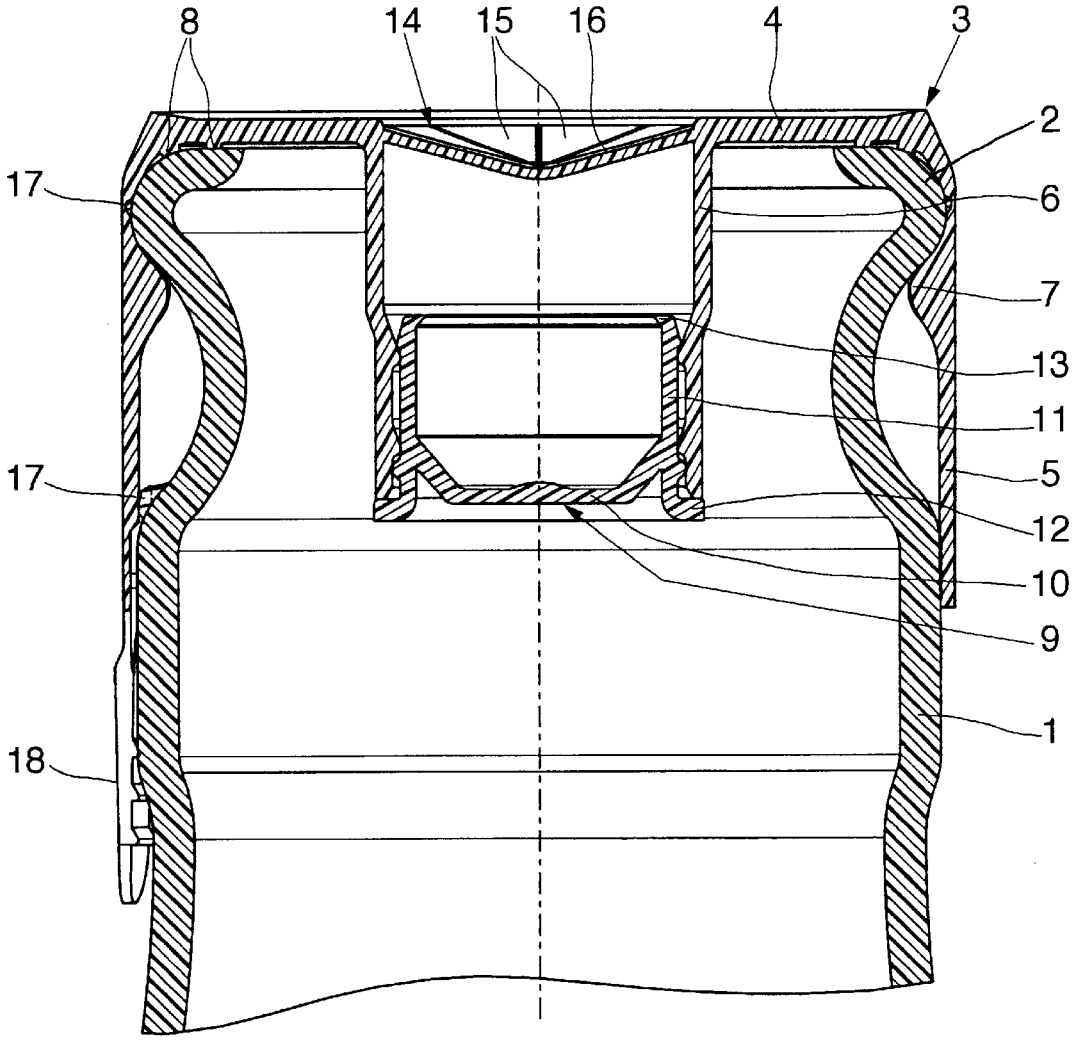
FIG. 3 is a view in section taken along the line III—III in FIG. 2.
Figure 4:
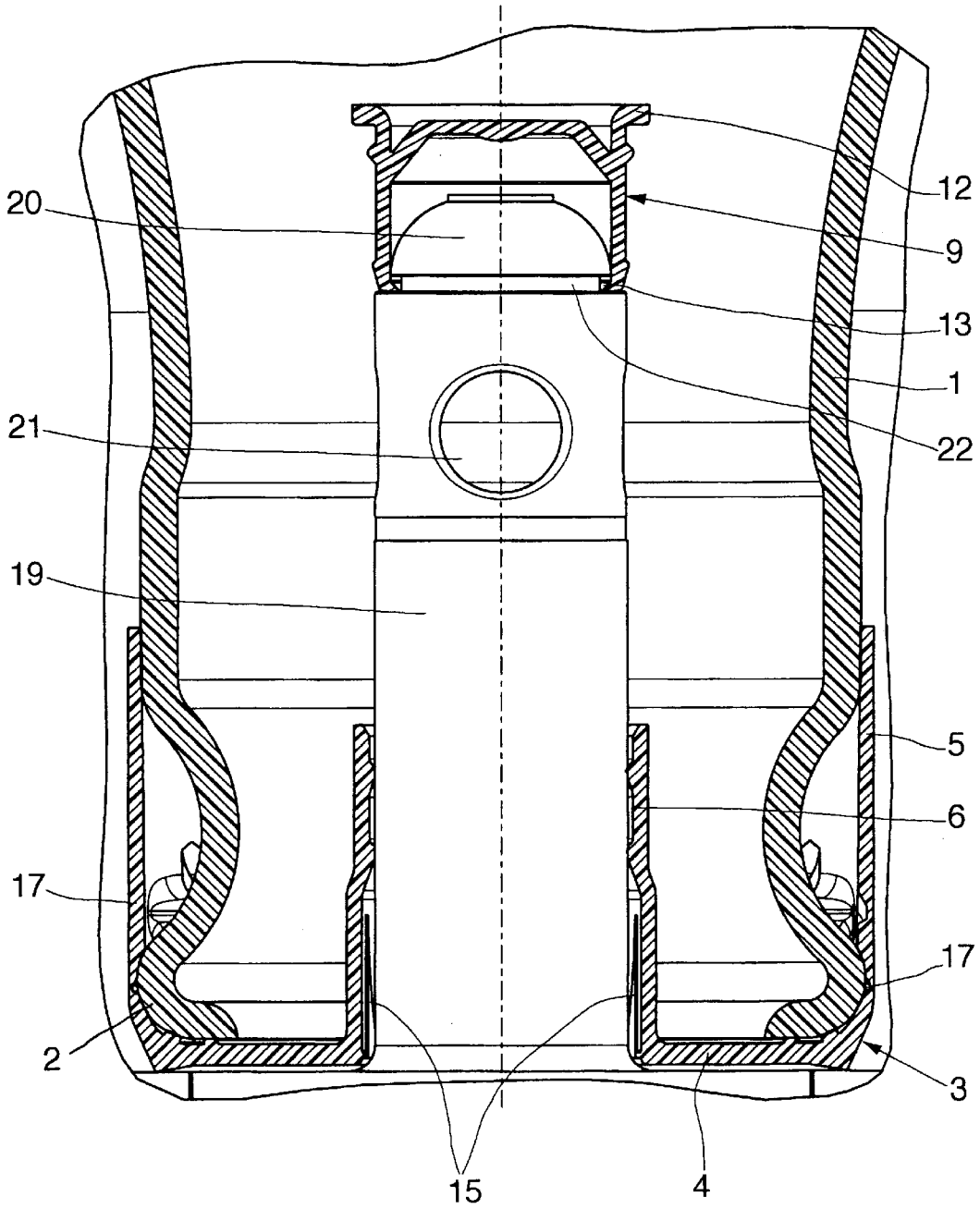
FIG. 4 is a sectional view like FIG. 3 showing the stopper device after the bottle is fitted to a dispenser.

As can be seen in FIGS. 3 and 4, the neck 1 has an attachment outside bead 2 at its free end.

The stopper device comprises a capsule 3 essentially consisting of an end wall 4 from which project in the same direction an essentially cylindrical outer skirt 5 and an essentially cylindrical inner chimney 6.

The skirt 5 has an inside bead 7 at the top divided into a plurality of sectors and cooperating with the outside bead 2 on the neck 1 to secure the capsule 3 to the neck 1. The capsule 3 is sealed to the neck 1 by one or more lip seals 8 formed on the inside of the capsule 3 in the area where the skirt 5 merges with the end wall 4 or by other sealing means such as a seal attached to the inside of the end wall 4.

A bucket-shape stopper 9 is nested inside the free end of the chimney 6. The stopper 9 essentially comprises an end wall 10, a substantially cylindrical wall 11 projecting from the end wall 10 and an annular outside rim 12 level with the end wall 10 adapted to bear against the free end of the chimney 6 when the stopper 9 is nested inside the chimney 6 (see FIG. 3).

Note that the cylindrical wall 11 of the stopper 9 has an inside rim 13 at its free end, the function of which will emerge from the description of FIG. 4.

Other details of the stopper 9 and the chimney 6 and the manner in which the stopper 9 cooperates with the chimney 6 are given in the documents already mentioned corresponding to the prior art, to which explicit reference is made.

Level with the end wall 4 of the capsule 3 the chimney 6 is closed by a closure 14 molded in one piece with the capsule 3 in the form of an easily ruptured diaphragm consisting of eight petals 15 in the shape of sectors of a circle connected by radial tear lines 16. The closure 14 is preferably slightly conical in shape, with the apex of the cone facing towards the stopper 9.

The diameter and the length of the chimney 6 are such that when the stopper 9 is fully nested inside the chimney 6 with its outside rim 12 pressed against the free end of the chimney 6, the inside rim 13 at the free end of the wall 11 of the stopper 9 is separated from the closure 14 by a distance corresponding at least to the radius of the chimney 6 and therefore substantially to the length of the petals 15.

The skirt 5 has a tear line (line of weakness) 17 on the inside which extends from the free end of the skirt, across the interior bead 7, which is interrupted at this point, to a point between the bead 7 of the skirt 5 and the end wall 4, substantially level with the apex of the outside bead 2 on the neck 1 of the bottle. A holding lug 18 is provided on the skirt 5 for pulling it off, i.e. for tearing the capsule 3 along the tear line 17, as a result of which the remaining capsule is no longer held onto the neck 1 of the bottle.

Referring to FIG. 4, the bottle filled with water, closed by the capsule 3, is placed upside-down on a dispenser of which only the dispenser tube 19 is shown since this is the only part of the dispenser that cooperates with the stopper device of the present invention. The head (top end) 20 of the dispenser tube 19 which has, below its head, at least one dispensing hole 21, first ruptures the closure 14 at the tear line 16, in other words subdivides the closure 14 into eight petals 15 which, remaining attached to the chimney 6 at the end, are bent upwards by the head 20 of the dispenser tube 19. The head 20 of the closure 19 then enters the free end of the stopper 9, the inside rim 13 of which clips into a groove 22 between the head 20 and the cylindrical body of the closure 19. The closure 19, entraining the stopper 9 then pushes the latter upwards out of the chimney 6, which enables the water contained in the bottle to flow out through the dispensing holes 21 into the closure 19 and therefore to feed the dispenser.

When the bottle is lifted to remove it from the dispenser, whether it is empty or still contains water, the closure 19 to which the stopper 9 is still clipped pulls the stopper 9 into the free end of the chimney 6 until the outside rim 12 abuts against the free end of the chimney 6 with the result that the stopper 9, now nested entirely in the chimney 6, is detached from the closure 19, so that the capsule is again sealed.

To refill the bottle at the source, the skirt 5 is torn off along the tear line 17 by pulling on the lug 18, whereupon the capsule can be removed by hand without effort, being no longer secured to the neck of the bottle. After refilling the bottle a new stopper device is placed on the neck 1 with the closure 14 and the skirt 5 intact, which guarantees the origin of the contents of the bottle (double tamperproofing function).

Figure 5:
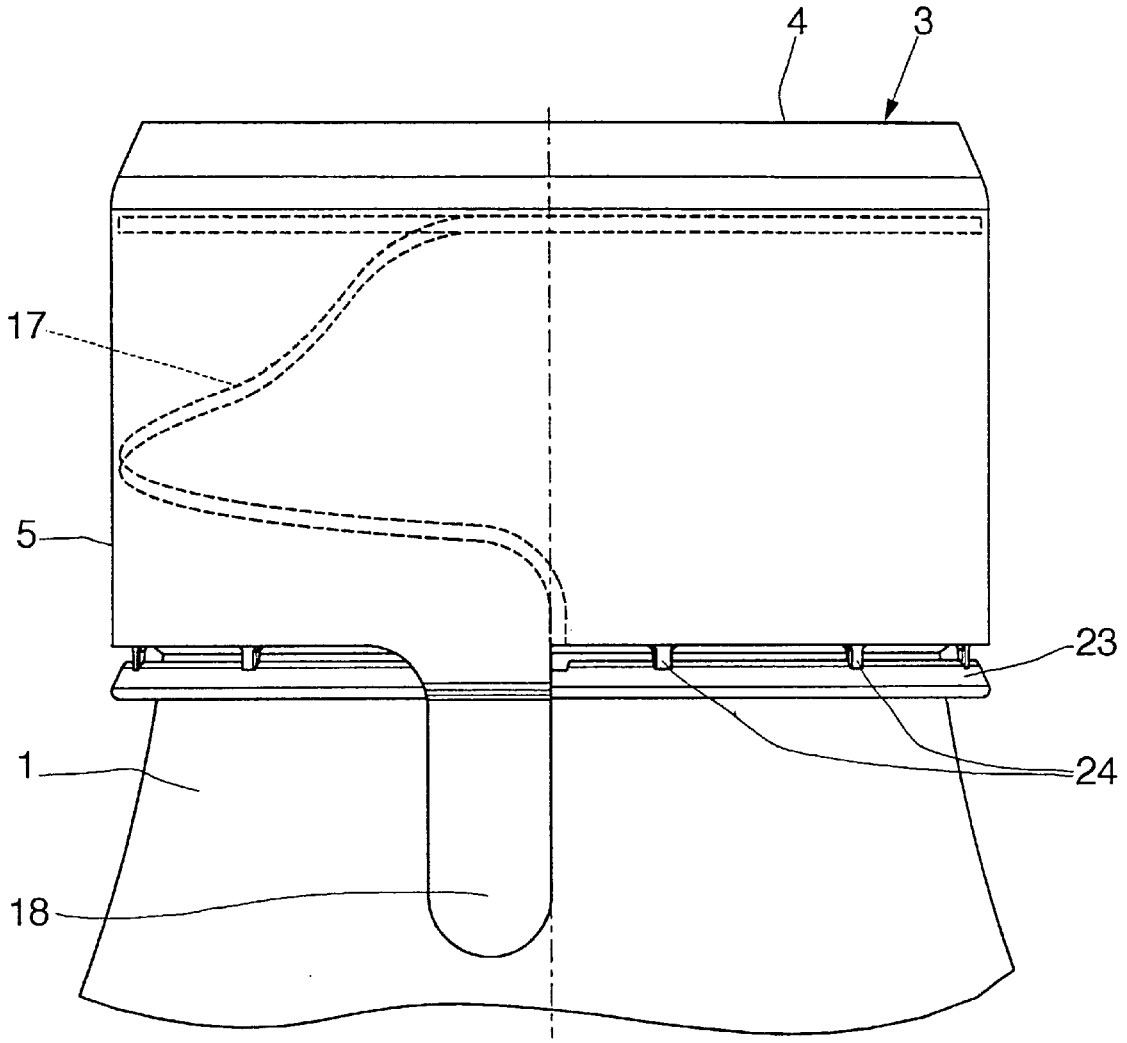
FIG. 5 is a view in lateral elevation of a second embodiment of a stopper device in accordance with the invention.
Figure 6:
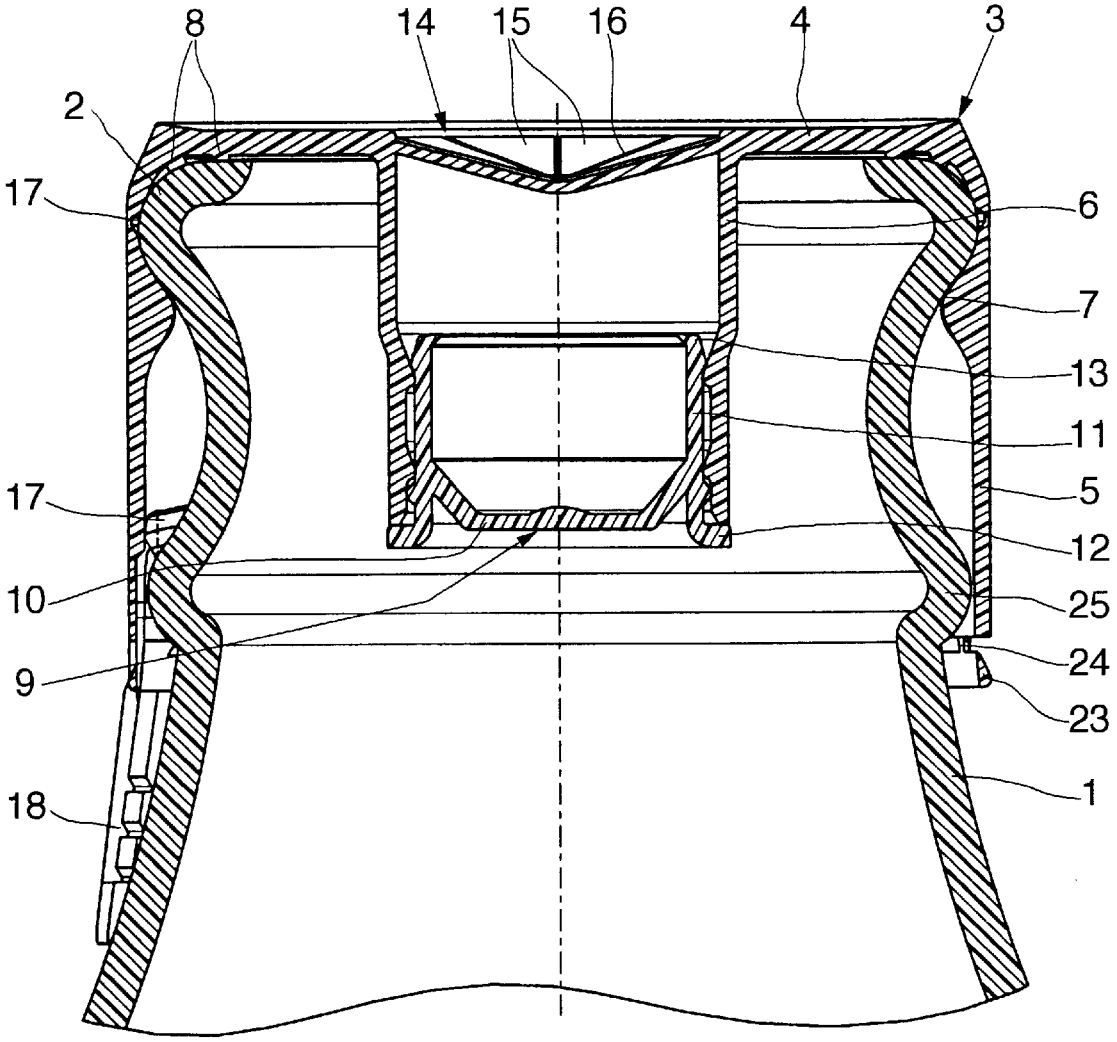
FIG. 6 is a view of the device from FIG. 5 in axial section.

As shown in FIGS. 5 and 6, the stopper device of the invention can be provided with third tamperproofing means consisting in a circumferential tamperproofing ring or strip 23 connected to the free end of the skirt 5 by easily ruptured means such as a line of a weakness or individual bridges 24, for example, the ring 23 being engaged behind a second outside bead 25 on the neck 1 of the bottle at a distance below the top bead 2. The tamperproofing or guarantee ring 23 can be of any type known in itself but is preferably a heat-shrink ring which is shrunk when fitting the capsule, after filling the bottle. This guarantee ring complements the two tamperproofing or guarantee means consisting of the closure 14 an the tear-off skirt 5.

Heat-shrink tamperproofing rings of this kind are described in documents GB-A-1 384 370, U.S. Pat. No. 4,033,472 and U.S. Pat. No. 4,206,851, for example, to which explicit reference is made.

Note that in FIG. 6 the heat-shrink tamperproofing ring 23 is shown before it is shrunk.

Although in the embodiments shown and described the stopper device includes, like "NON-SPILL" capsules known in themselves, a stopper 9 which closes off the chimney 6 except when the dispenser tube 19 of the dispenser is nested in the chimney, it should be noted that the stopper device of the invention can be used with no stopper 9. The closure 14, if it is not destroyed by the dispenser tube 19, not only constitutes a guarantee or tamperproofing means, but also seals the capsule. Of course, with no stopper 9, the capsule does not prevent water flowing out of the bottle if removed from the dispenser before it is completely empty.

There is claimed:

1. A closure device for a bottle having a neck provided with an outside bead at a free end thereof and intended for use with a water fountain type liquid dispenser, the closure device comprising:

an end wall;

a substantially cylindrical outer skirt extending from the end wall in a first direction, the outer skirt having an interior bead adapted to hook behind the outside bead on the neck of a bottle;

a substantially cylindrical inner chimney extending from the end wall in the first direction, the inner chimney being adapted to nest therein a dispenser tube of a water fountain type liquid dispenser received through an end wall side of the inner chimney; and a tamperproofing frangible closure closing off the inner chimney, the tamperproofing frangible closure being positioned at an end wall side of the inner chimney such that the tamperproofing frangible closure is irrevocably ruptured by a dispenser tube of a water fountain type liquid dispenser upon nesting of the dispenser tube within the inner chimney, and a rupture of the tamperproofing frangible closure is distinctly visible from outside of a bottle employing the closure device.

2. A closure device according to claim 1, further including a stopper for cooperating with a free end of the inner chimney and a dispenser tube of a water fountain type liquid dispenser nesting within the inner chimney to operate as a valve system for a bottle employing the closure device.

3. A closure device according to claim 1, wherein the tamperproofing frangible closure is adapted to remain attached to the closure device after being ruptured.

4. A closure device according to claim 3, further including a stopper for cooperating with a free end of the inner chimney and a dispenser tube of a water fountain type liquid dispenser nesting within the inner chimney to operate as a valve system for a bottle employing the closure device, and wherein the tamperproofing frangible closure is positioned with respect to the stopper such that the tamperproofing frangible closure, when ruptured, does not interfere with the stopper.

5. A closure device according to claim 1, wherein the tamperproofing frangible closure is a diaphragm including at least two parts joined together by frangible lines and is adapted to remain attached to the closure device after being ruptured.

6. A closure device according to claim 5, wherein the diaphragm includes at least three petal-shaped parts.

7. A closure device according to claim 5, further including a stopper for cooperating with a free end of the inner chimney and a dispenser tube of a water fountain type liquid dispenser nesting within the inner chimney to operate as a valve system for a bottle employing the closure device, and wherein the unruptured chimney tamperproofing frangible closure is positioned at a distance from the stopper of at least a radial length of the parts of the tamperproofing frangible closure.

8. A closure device according to claim 1, wherein the outer skirt extends beyond the interior bead and includes tear means shaped to assure tearing of the outer skirt beyond the interior bead.

9. A closure device according to claim 8, wherein the outer skirt includes a tear line extending from a free end of the outer skirt to a plane substantially corresponding to a top of the outside bead on the neck of a bottle employing the closure device, the tear line being interrupted at the interior bead.

10. A closure device according to claim 1, further including a tamperproofing ring positioned at a free end of the outer skirt for cooperating with a second outside bead on a neck of a bottle employing the closure device.

11. A closure device according to claim 10, wherein the tamperproofing ring is formed from heat-shrink material.

12. A closure device according to claim 1, wherein the closure device is formed of plastics material, and the end wall, outer skirt, inner chimney and tamperproofing frangible closure are molded as a single piece.

* * * * *